US005791139A

United States Patent [19]

Atago et al.

[11] Patent Number: 5,791,139

[45] Date of Patent: Aug. 11, 1998

[54] FUEL INJECTION CONTROL METHOD FOR AN INTERNAL-COMBUSTION ENGINE PROVIDED WITH NOX REDUCING CATALYTIC CONVERTER AND FUEL INJECTION CONTROLLER

[75] Inventors: Takeshi Atago; Toshio Hori; Yuichi Kitahara, all of Hitachinaka; Osamu Kuroda, Hitachi, all of Japan

[73] Assignee: Hitachi, Ltd., Tokyo, Japan

[21] Appl. No.: 393,841

[22] Filed: Feb. 24, 1995

[30] Foreign Application Priority Data

Feb. 28, 1994 [JP] Japan ..... 6-029273

[51] Int. Cl.[6] ..... F01N 3/20

[52] U.S. Cl. ..... 60/274; 60/276; 60/285; 60/301

[58] Field of Search ..... 60/274, 276, 285, 60/301

[56] References Cited

U.S. PATENT DOCUMENTS 5,437,153 8/1995 Takeshima ..... 60/285

5,473,887 12/1995 Takeshima ..... 60/285

*Primary Examiner*—Douglas Hart

*Attorney, Agent, or Firm*—Bardehle, Pagenberg, Dost, Altenburg, Frohwitter, Geissler

[57] ABSTRACT

A fuel injection control method controls the air-fuel ratio of the air-fuel mixture to be supplied to an internal-combustion engine provided in its exhaust system with an NOx reducing catalytic converter so that the NOx reducing catalytic converter is able to give full play to its ability. A first air-fuel mixture of a stoichiometric or a fuel-rich air-fuel ratio and a second air-fuel mixture of a lean-fuel air-fuel ratio are supplied alternately for predetermined time intervals respectively. The air-fuel ratio is determined selectively on the basis of parameters indicating the operating condition of the internal-combustion engine and/or factors relating to the time of duration of operation of the internal-combustion engine under predetermined operating conditions, and the ratio between the predetermined time intervals is determined according to parameters indicating the operating condition of the internal-combustion engine and an NOx reduction ratio at which the NOx concentration of the exhaust gas must be reduced to meet an NOx concentration specified in an emission standard.

7 Claims, 8 Drawing Sheets

FUEL INJECTION CONTROL METHOD FOR AN INTERNAL-COMBUSTION ENGINE PROVIDED WITH NOX REDUCING CATALYTIC CONVERTER AND FUEL INJECTION CONTROLLER

BACKGROUND OF THE INVENTION

1. Field of the Invention

The present invention relates to a method of controlling fuel injection in an internal-combustion engine, and a fuel injection controller for carrying out the method and, more particularly, to a method of controlling fuel injection in an internal-combustion engine provided with an NOx reducing catalytic converter, capable of reducing the NOx concentration of the exhaust gas to the least extent without using a plurality of catalysts, and a fuel injection controller for carrying out the method.

2. Description of the Related Art

Although the exhaust gas purifying ability of an exhaust gas purifying technique in accordance with an invention disclosed, for example, in Japanese Patent Laid-open (Kokai) No. 63-100919 employing an NOx reducing catalyst is effective when a lean air-fuel mixture is used, the exhaust gas purifying ability of the same technique is not reliable when a stoichiometric air-fuel mixture having a comparatively small oxygen concentration is used. A similar technique is disclosed in Japanese Patent Lid-open (Kokai) No. 5-133260.

Those prior art techniques need at least two kinds of catalysts, namely, an NOx reducing catalyst, and an oxidation catalyst or a three-way catalyst. Although three-way catalytic converters have been used and effective three-way catalytic converters are available, the development of effective NOx reducing catalysts has been desired.

The present invention has been made on the basis of a fact that a three-way catalytic converter fabricated by attaching Rh, Pt and/or Pd, and La to a porous carrier has an NOx reducing ability when a lean air-fuel mixture is used for combustion and that the NOx reducing ability of the three-way catalytic converter deteriorates with the duration of operation of the internal-combustion engine on a lean air-fuel mixture.

SUMMARY OF THE INVENTION

It is an object of the present invention to provide a fuel injection control method capable of making the three-way catalytic converter give full play to its ability, and a fuel injection controller for carrying out the fuel injection control method.

The present invention measures the duration of operation of an internal-combustion engine on a lean air-fuel mixture and supplies the lean air-fuel mixture, and a stoichiometric air-fuel mixture or a fuel-rich air-fuel mixture alternately at a time ratio to maintain the NOx reduction ratio on a high level while the lean air-fuel mixture is supplied. For example, in an LA4 mode, the NOx reduction ratio is dependent on the ratio of the duration of operation of the internal-combustion engine on a lean air-fuel mixture to that of operation on a stoichiometric fuel mixture (hereinafter referred to as "LS ratio"). Therefore the control of the LS ratio is important.

Accordingly, the present invention provides a fuel injection control method that controls the air-fuel ratio of an air-fuel mixture to be supplied to an internal-combustion engine on the basis of parameters indicating the operating condition of the internal-combustion engine and/or the duration of operation of the internal-combustion engine under predetermined conditions.

The NOx reducing ability of a three-way catalytic converter fabricated by attaching Rh, Pt and/or Pd, and La to a porous carrier is effective when a lean air-fuel mixture is supplied to an internal-combustion engine, the NOx reducing ability of the three-way catalytic converter deteriorates with the duration of operation of the internal-combustion engine on the lean air-fuel mixture, and the original NOx reducing ability of the three-way catalytic converter can be restored when the three-way catalytic converter is exposed to an exhaust gas discharged from the internal-combustion engine operating on a stoichiometric air-fuel mixture. Therefore, the LS ratio must properly be controlled to able the three-way catalytic converter function effectively when the internal-combustion engine operates on a lean air-fuel mixture.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
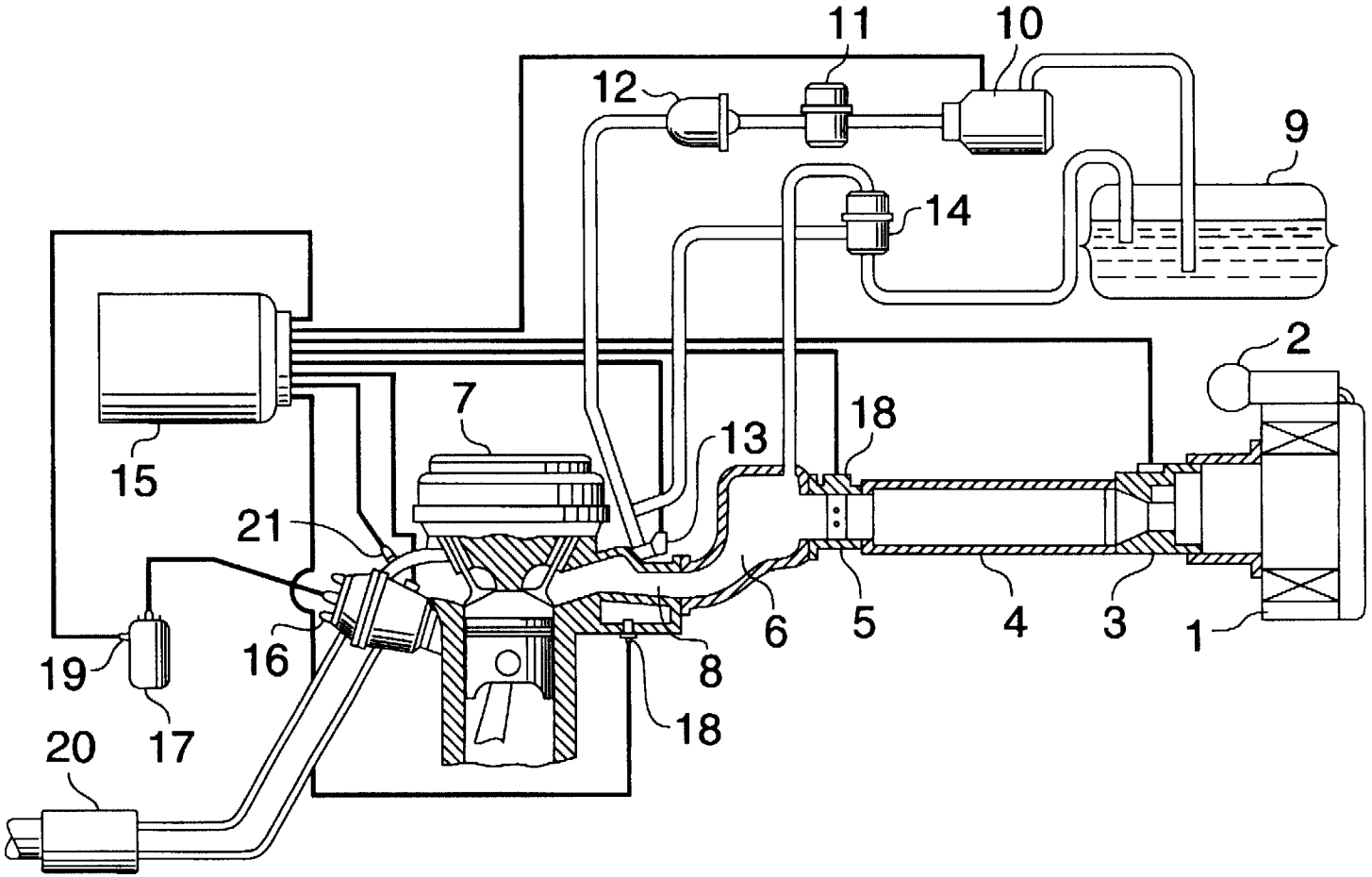
FIG. 1 is a schematic view of an air-fuel supply system to be controlled by a fuel injection controller in a preferred embodiment according to the present invention.

Referring to FIG. 1, an internal-combustion engine 7 (hereinafter referred to simply as "engine") is provided with an air-fuel supply system to be controlled by a fuel injection controller in a preferred embodiment according to the present invention. The air-fuel supply system comprises an air intake system and a fuel injection system. The air intake system comprises an air cleaner 1 having an air inlet opening 2 through which air is sucked by the suction of the engine 7, an air flow meter 3, an air intake pipe 4, a throttle valve 5 having a throttle valve element for regulating intake air flow rate, a collector 6, and an intake manifold 8 for distributing intake air to the cylinders (only one of them is shown) of the engine 7. The fuel injection system comprises a fuel tank 9 containing the fuel, such as gasoline, a fuel pump 10 for pumping up the fuel from the fuel tank 10 and sending out the fuel by pressure, a fuel damper 11, a fuel filter 12, fuel injection valves 13 (only one of them is shown) and a fuel pressure regulator 14 for maintaining fuel pressure within a specified range. The fuel is injected into the branch pipes of the intake manifold 8 by the fuel injection valves 13 provided respectively on the branch pipes of the intake manifold 8. The fuel injection system is controlled by a fuel injection controller 15.

The air flow meter 3 gives a signal representing an intake air flow rate to the fuel injection controller 15. A throttle sensor 18 detects the opening of the throttle valve 5 and gives a signal representing the opening of the throttle valve 5 to the fuel injection controller 15. A distributor 16 is provided with a crank angle sensor which gives a reference angle signal REF indicating the crank angle of the crankshaft of the engine 7 and an angle signal POS for detecting the engine speed to the fuel injection controller 15. An oxygen sensor 21 provided on the exhaust manifold of the engine 7 detects the oxygen concentration of the exhaust gas for estimating actual air-fuel ratio and gives a detection signal to the fuel injection controller 15. The oxygen sensor 21 is incapable of determining actual air-fuel ratio. The oxygen sensor 21 provides an output of about 1 V when a fuel-rich air-fuel mixture, i.e., an air-fuel mixture having an air-fuel ratio smaller than a stoichiometric air-fuel ratio, is supplied, and provides an output on the order of 0.2 V when a lean air-fuel mixture, i.e., an air-fuel mixture having an air-fuel ratio greater than a stoichiometric air-fuel ratio, is supplied. It is most desirable to use an air-fuel ratio sensor capable of actually determining the air-fuel ratio of the air-fuel mixture, if available, instead of the oxygen sensor 21. The exhaust pipe is provided with a three-way catalytic converter 20 capable of converting the toxic components including CO, hydrocarbons and NOx of the exhaust gas into untoxic substances. The three-way catalytic converter 20 is capable of reducing NOx, which will be explained later.

Figure 2:
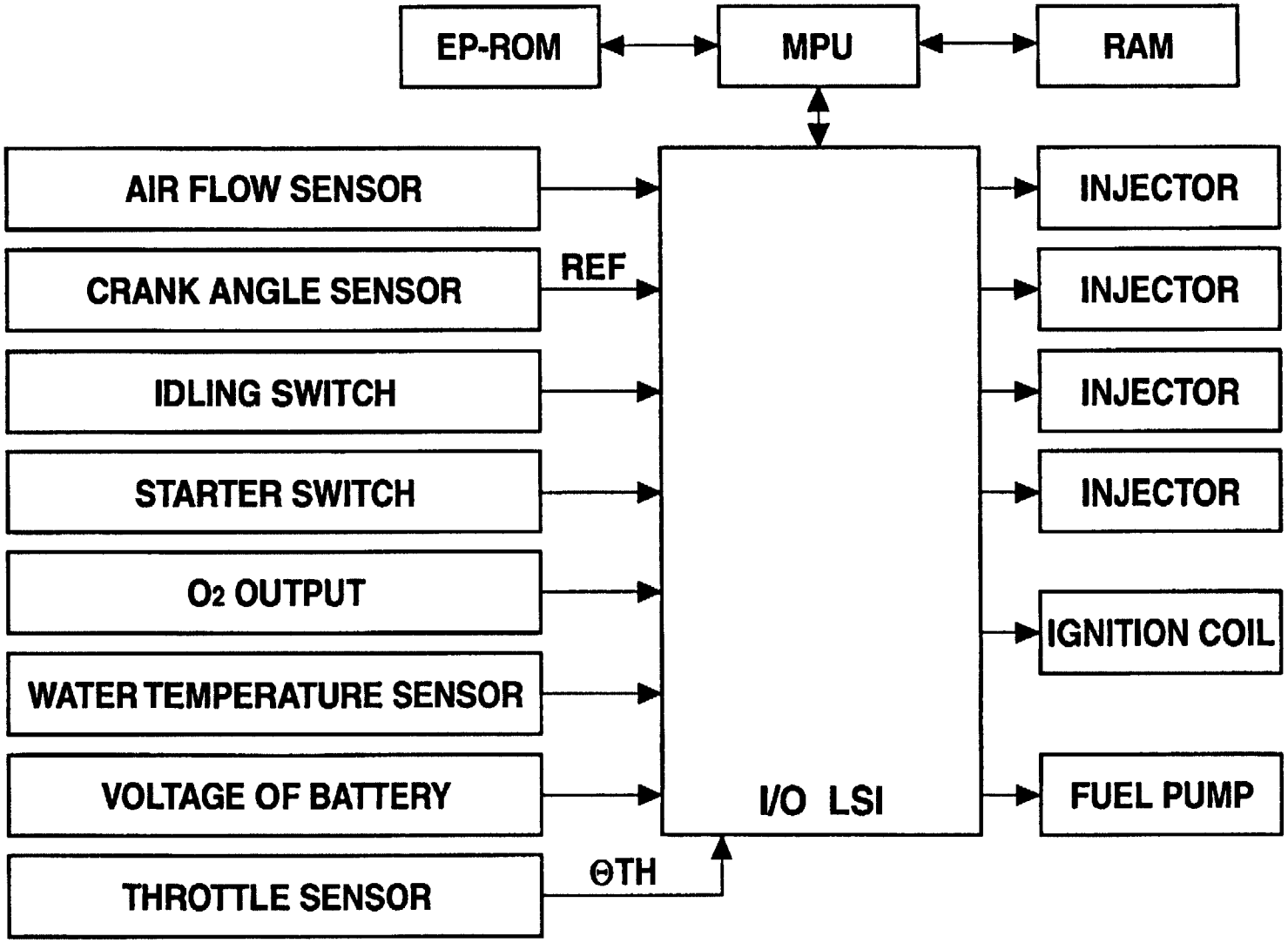
FIG. 2 is a block diagram of the fuel injection controller for controlling the air-fuel supply system of FIG. 1.

As shown in FIG. 2, the fuel injection controller 15 comprises, as principal components, a MPU (microprocessor unit), an EPROM (erasable programmable ROM), a RAM and an I/O interface. The MPU processes signals provided by sensors for detecting the values of parameters indicating the operating condition of the engine 7, including an engine speed sensor and an engine load sensor and given thereto through the I/O interface, and gives a pulse signal to the fuel injection valves 13. The pulse width of the pulse signal is determined on the basis of the values of the parameters so that an air-fuel mixture of a desired air-fuel ratio is supplied to the engine 7. The MPU further gives an ignition coil control signal to an ignition coil 17 to control the ignition timing. Thus, the fuel injection controller 15 controls both air-fuel ratio and ignition timing.

Figure 3:
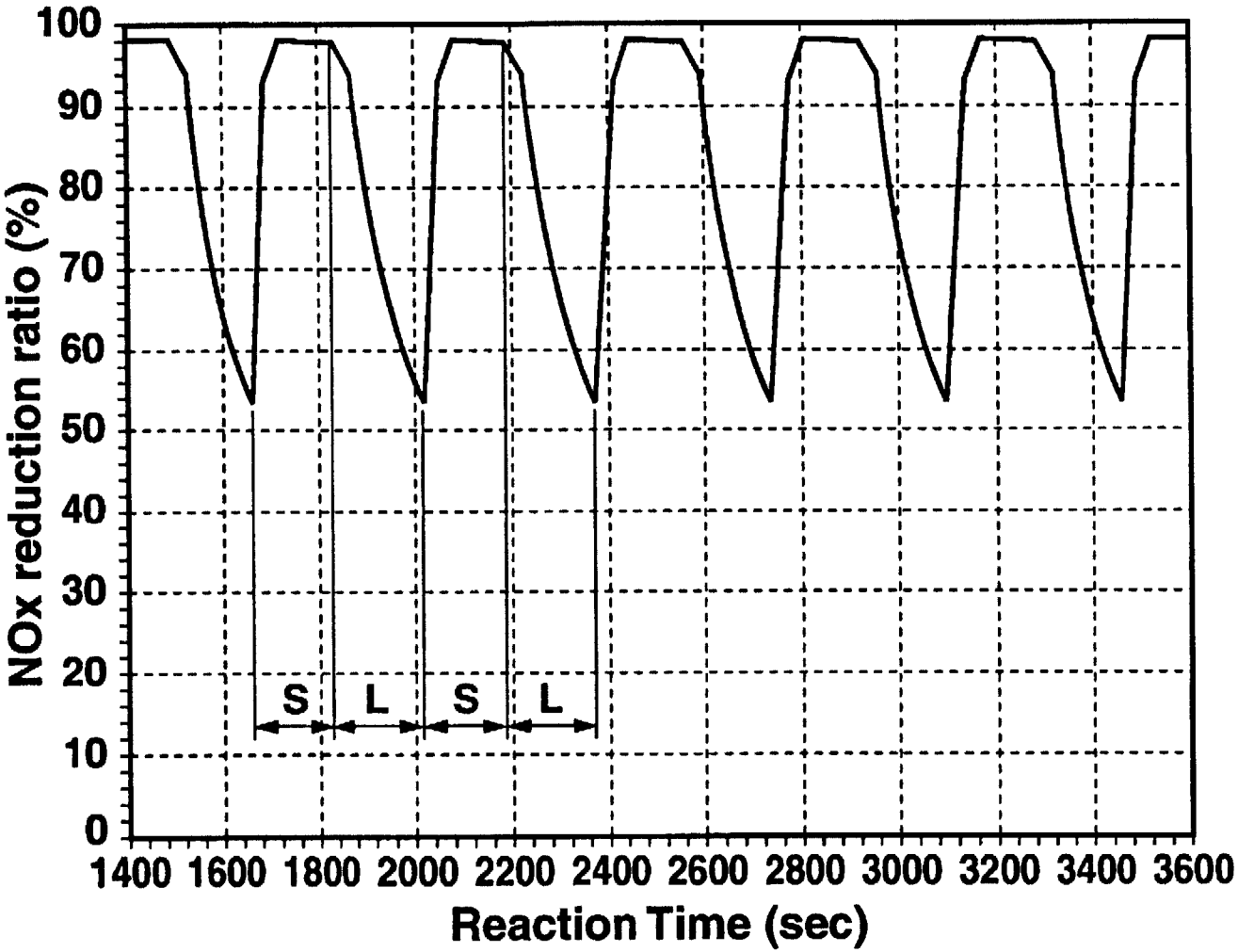
FIG. 3 is a graph showing the variation of the NOx reducing performance of a three-way catalytic converter with time when the air-fuel ratio is controlled by the fuel injection controller of FIG. 2.

FIG. 3 shows, by way of example, the variation of the NOx reducing ability of the three-way catalytic converter 20 with the duration of operation of the engine 7, in which measured NOx reduction ratio is measured upward on the vertical axis and time is measured to the right on the horizontal axis. In FIG. 3, time intervals indicated at "L" are those in which a lean air-fuel mixture is supplied and at "S" are those in which a stoichiometric air-fuel mixture is supplied. As is obvious from FIG. 3, the NOx reduction ratio is nearly equal to 100% while the stoichiometric air-fuel mixture is supplied. When a lean air-fuel mixture is supplied the NOx reduction ratio decreases gradually with time and, in the worst case, decreases to a value on the order of 50% or below. The three-way catalytic converter 20 is fabricated by attaching Rh, Pt and/or Pd, and La to a porous carrier. The NOx reducing ability of the three-way catalytic converter is dependent on the respective amounts of those catalytic metals, and the NOx reducing ability can be enhanced by attaching additional catalytic metals to the porous carrier. Generally, the NOx reducing ability of three-way catalytic converter decreases with the duration of operation of the engine on a lean fuel-air mixture and, theoretically, it is impossible to change such a tendency, which will more explicitly be described hereinafter with reference to FIGS. 4 and 5.

Figure 4:
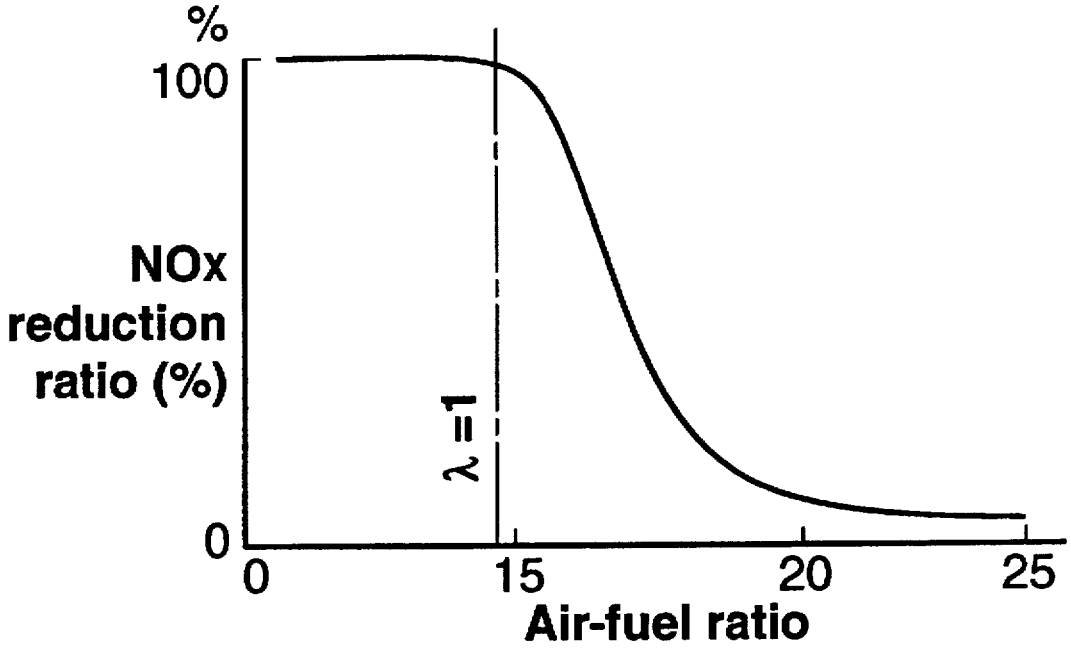
FIG. 4 is a graph showing the dependence of the NOx reduction ratio at which the three-way catalytic converter employed in the present invention reduces NOx on the air-fuel ratio.
Figure 5:
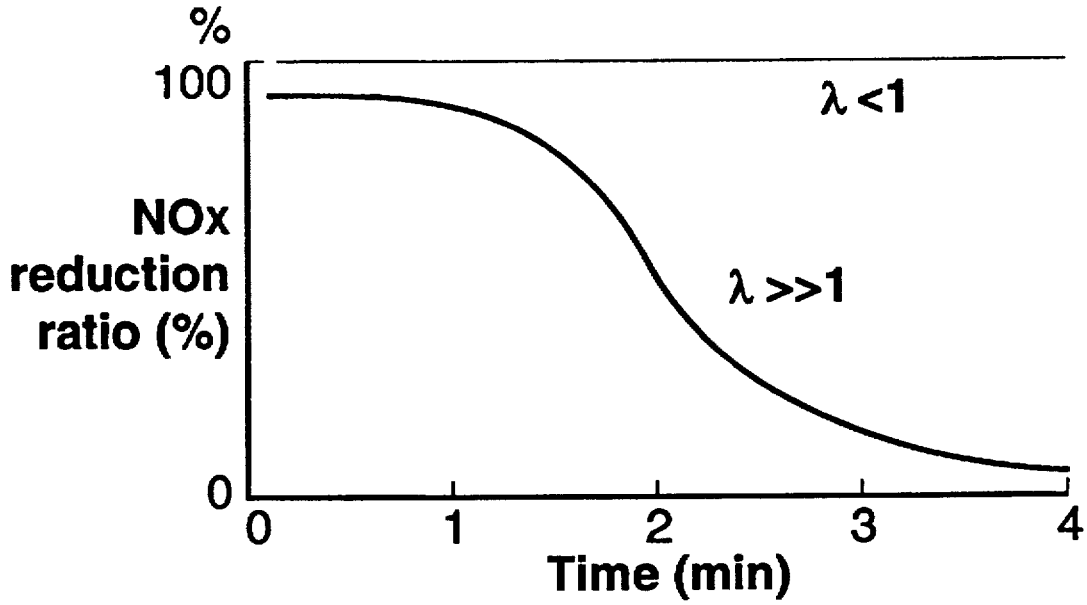
FIG. 5 is a graph showing the variation of the NOx reduction ratio at which the three-way catalytic converter employed in the present invention reduces NOx with time.

FIG. 4 shows the dependence of the NOx reduction ratio on the air-fuel ratio when the engine 7 is operating in a steady state. When a fuel-rich air-fuel mixture is supplied, i.e., when the air-fuel ratio is in a range of air-fuel ratio in which the air-fuel ratio is smaller than a stoichiometric air-fuel ratio of 14.7, the NOx reduction ratio is substantially 100%. As the air-fuel ratio increases beyond the stoichiometric air-fuel ratio, the NOx reduction ratio decreases gradually and decreases virtually to zero when the air-fuel ratio is about 22. As shown in FIG. 5, the NOx reduction ratio is very high at the initial stage of operation after the air-fuel ratio has been changed from a low air-fuel ratio lower than the stoichiometric air-fuel ratio to a high air-fuel ratio higher than the stoichiometric air-fuel ratio because the three-way catalytic converter 20 is capable of adsorbing NOx. In this state, the NOx reduction ratio decreases with time and decreases virtually to zero in about two minutes. The high initial NOx reduction ratio can be restored by changing the air-fuel ratio from the high air-fuel ratio higher than the stoichiometric air-fuel ratio to the low air-fuel ratio lower than the stoichiometric air-fuel ratio. Thus, the NOx reducing ability of the three-way catalytic converter 20 can be changed cyclically by changing the air-fuel ratio between a low air-fuel ratio and a high air-fuel ratio.

Figure 6:
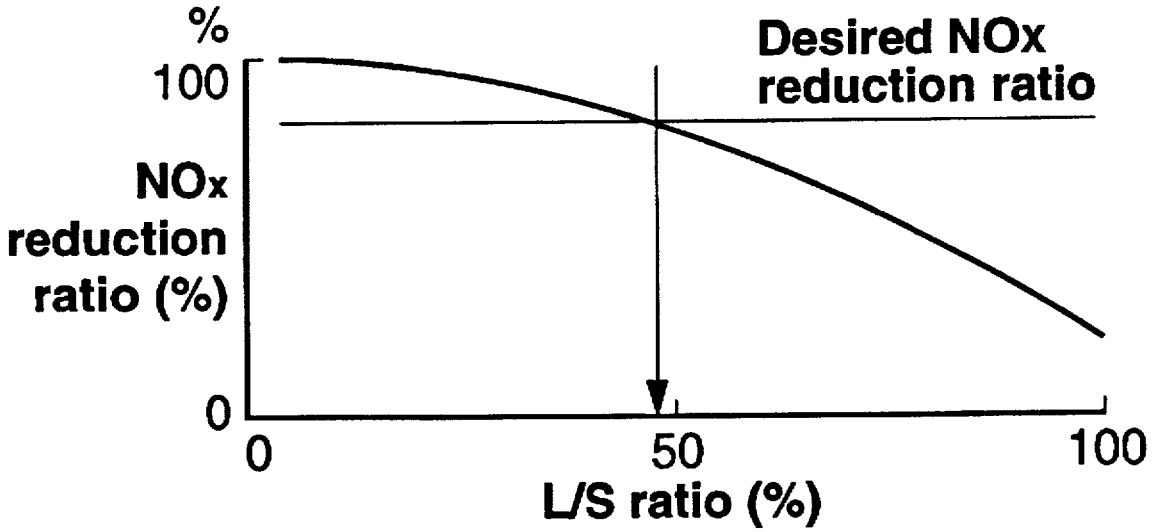
FIG. 6 is a graph showing the relation between the NOx reduction ratio at which the three-way catalytic converter employed in the present invention reduces NOx and the LS ratio.
Figure 7:
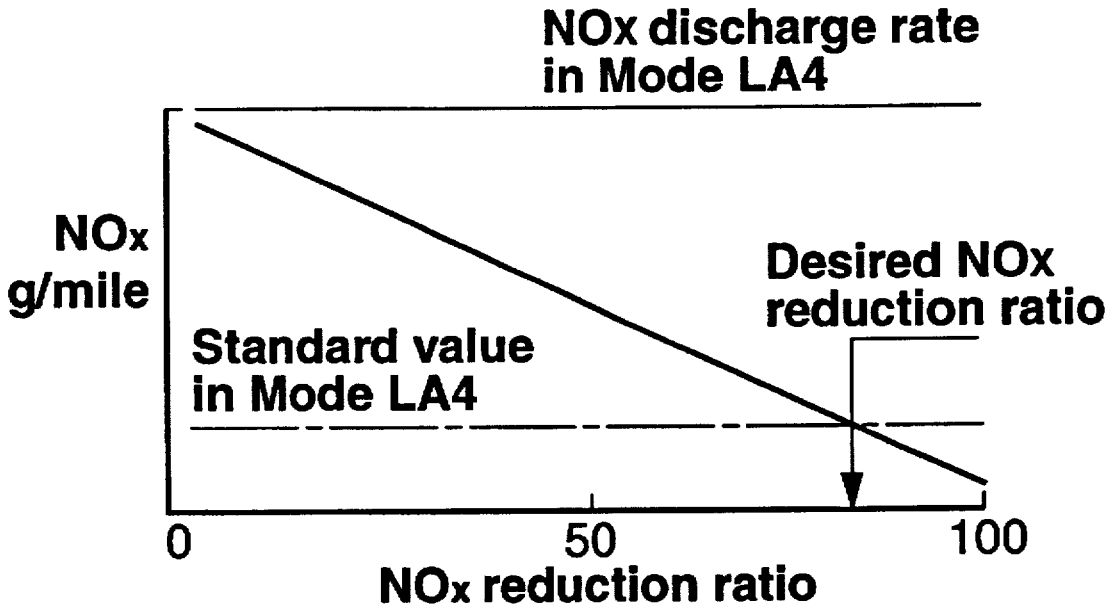
FIG. 7 is a graph of assistance in explaining the desired NOx reduction ratio of the catalyst employed in the present invention.

The NOx reduction ratio will further be examined with reference to FIG. 6. In view of the NOx reducing ability of the three-way catalytic converter 20, suppose that the duration of supply of a lean air-fuel mixture is two minutes by way of example and the LS ratio is varied; that is, the duration of the supply of a lean air-fuel mixture is fixed and the duration of supply of a stoichiometric air-fuel mixture is varied. As is obvious from FIG. 6, the NOx reduction ratio varies with the LS ratio. For example, when limiting the NOx concentration of the exhaust gas of the engine 7 below an NOx concentration specified in the emission standard while the engine 7 is operating in the LA4 mode, a desired NOx reduction ratio can be calculated on the basis of the known NOx concentration of the exhaust gas of the engine 7. In the case illustrated in FIG. 7, the desired NOx reduction ratio is about 80%. Referring again to FIG. 6, the NOx reduction ratio is 80% when the LS ratio is 50%; that is, when the LS ratio is set to 50%, the NOx concentration of the exhaust gas conforms to the value specified in the emission standard.

Figure 8:
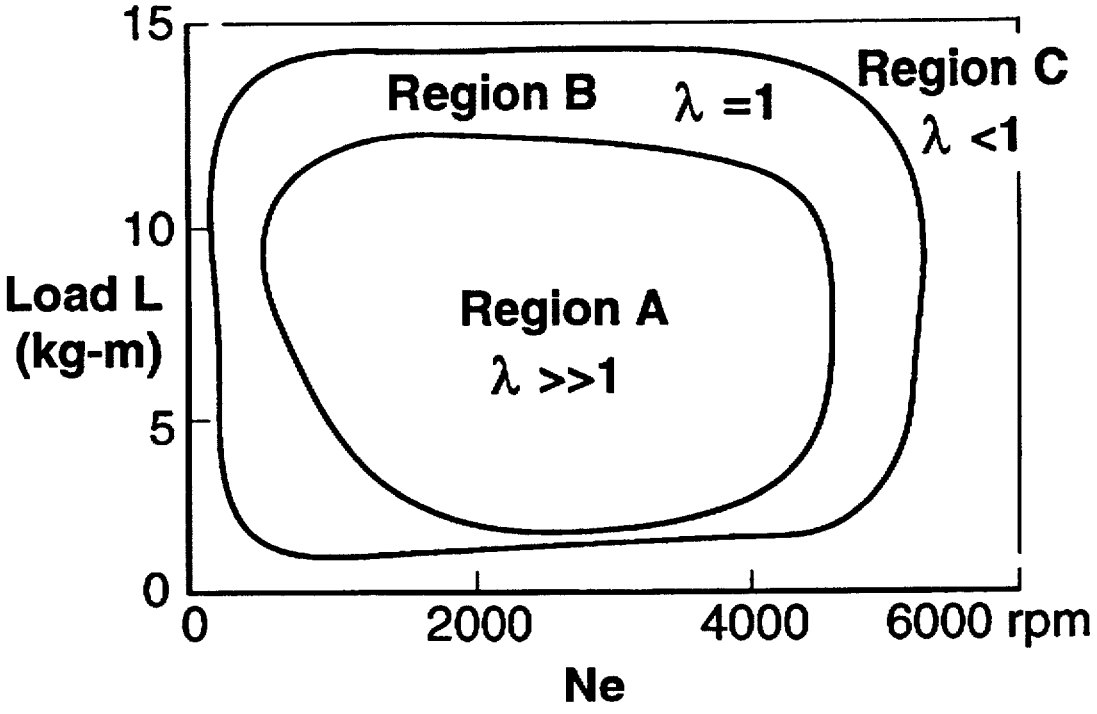
FIG. 8 is a graph showing appropriate air-fuel ratio as a function of parameters indicating the operating condition of the internal-combustion engine.

FIG. 8 shows air-fuel ratios required by the engine 7 for different operating conditions. A region A is a lean air-fuel mixture supply region, in which $\lambda >> 1$ and the air-fuel ratio is 22 or above, a region B a air-fuel mixture supply region, in which $\lambda = 1$, and a region C is a fuel-rich air-fuel mixture supply region, in which $\lambda < 1$, to secure necessary output power and to protect the engine 7. The regions A, B and C may be specified on a single map or on different maps respectively. Generally, air-fuel mixtures in the regions A and B are supplied for exhaust gas tests in the operation in the LA4 mode. The extent of the region A is dependent on the excess output power of the engine 7.

Figure 9:
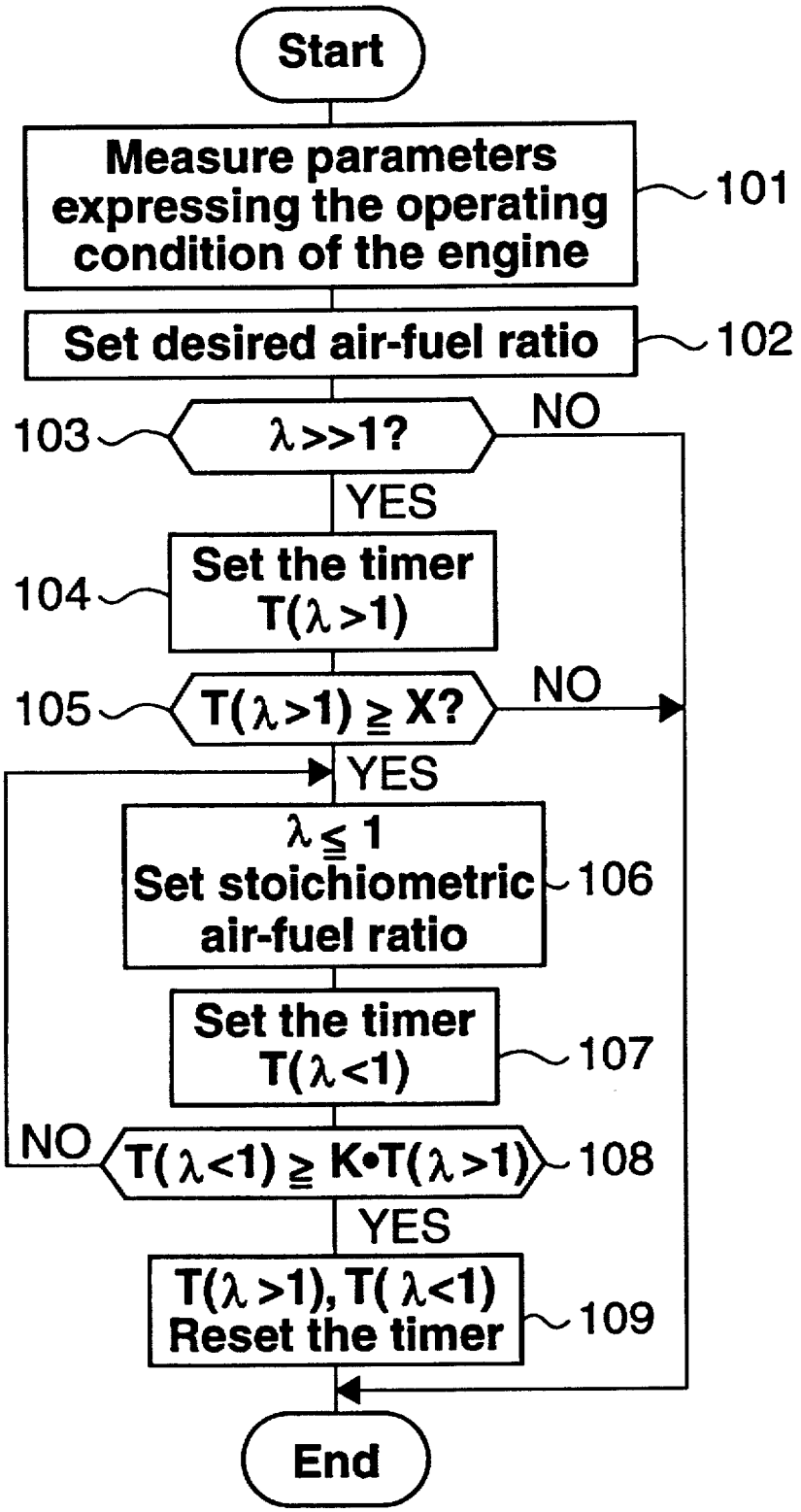
FIG. 9 is a flow chart of a fuel injection control method to be carried out by the fuel injection controller of FIG. 2.

An air-fuel ratio control procedure in accordance with the present invention will be de scribed hereinafter with reference to FIG. 9, in which only steps connected with the present invention among those of an engine control system are shown.

Figure 10:
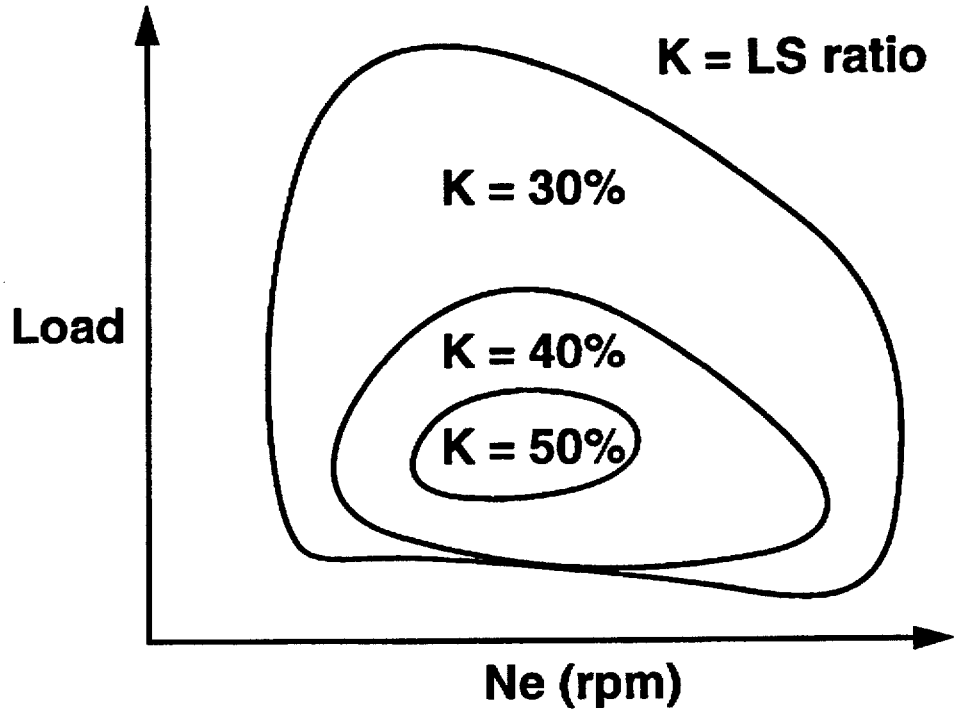
FIG. 10 is a graph of assistance in explaining the fuel injection control method of the present invention in connection with parameters indicating the operating condition of the internal-combustion engine.

In step 101, parameters indicating the operating condition of the engine 7, such as engine speed Ne and engine load L, are measured and one of the regions A, B and C shown in FIG. 8 is selected. In step 102, a desired air-fuel ratio is determined. In step 103, a query is made to see whether or not an inequality, $\lambda >> 1$ is satisfied. If the response in step 103 is negative, the air-fuel ratio control procedure is ended. If the response in step 103 is affirmative, a timer starts measuring the time $T(\lambda > 1)$ of duration of a condition in the region A in step 104. Then, a query is made in step 105 as to whether or not a set time {X}, for example, two minutes for which a lean air-fuel mixture is supplied as explained in connection with FIG. 5, has elapsed. If the set time {X} has not elapsed yet, the control operation for maintaining the air-fuel ratio for the region A is continued. If the set time {X} has elapsed, the air-fuel ratio is adjusted to a stoichiometric air-fuel ratio ($\lambda < 1$) in step 106. Even though the air-fuel ratio is changed, the engine 7 must be controlled by engine control means so that the operating condition of the engine 7 is not changed at all. In step 107, a timer measures the time $T(\lambda < 1)$ of duration of supply of a stoichiometric air-fuel mixture. In step 108, the time $T(\lambda < 1)$ measured by the timer is compared with a reference time $K*T(\lambda > 1)$. If the time $T(\lambda < 1)$ is shorter than the reference time $K*T(\lambda > 1)$, the procedure returns to step 106 to continue the control operation. If the time $T(\lambda < 1)$ measured by the timer is longer than the reference time $K*T(\lambda > 1)$, the timers are reset. In the reference time $K*T(\lambda > 1)$, K is the LS ratio, which is determined selectively according to the NOx concentration specified in the emission standard and the desired NOx reduction ratio. FIG. 10 is a map of K=LS ratio for engine load and engine speed.

Although the embodiment has been described on an assumption that the air-fuel ratio of the lean air-fuel mixture is 22, the air-fuel ratio of the lean air-fuel mixture may optionally be determined in connection with the LS ratio.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A fuel injection control method that controls the air-fuel ratio of air-fuel mixture to be supplied to an internal-combustion engine provided in its exhaust system with an NOx reducing catalytic converter comprising a porous alumina carrier, and Rh, Pt and/or Pd, and La attached to the porous alumina carrier, said fuel injection control method comprising controlling the air-fuel ratio of the air-fuel mixture on the basis of parameters indicating the operating condition of the internal-combustion engine, wherein a first air-fuel mixture of a stoichiometric or a fuel-rich air-fuel ratio and a second air-fuel mixture of a fuel-lean air-fuel ratio (of about 22) are supplied alternately for predetermined time intervals respectively, and wherein a ratio K of the time interval in which the first air-fuel mixture is supplied to the time interval in which the second air-fuel mixture is supplied is determined selectively on the basis of the NOx concentration of the exhaust gas of the internal-combustion engine, an NOx emission concentration specified in an emission standard, and the NOx reduction ratio of the NOx reducing catalytic converter.

2. A fuel injection control method according to claim 1, wherein the ratio K is determined according to the parameters indicating the operating condition of the internal-combustion engine.

3. A fuel injection controller for controlling the combustion of an internal-combustion engine provided in its exhaust system with an NOx reducing catalytic converter comprising a porous alumina carrier, and Rh, Pt and/or Pd, and La attached to the porous alumina carrier, and the air-fuel ratio of air-fuel mixture to be supplied to the internal-combustion engine, characterized in controlling the air-fuel ratio of the air-fuel mixture to be supplied to the internal-combustion engine on the basis of parameters indicating the operating condition of the internal-combustion engine, wherein a first air-fuel mixture of a stoichiometric or a fuel-rich air-fuel ratio and a second air-fuel mixture of a fuel-lean air-fuel ratio (of about 22) are supplied alternately for predetermined time intervals respectively, and wherein a ratio K of the time interval in which the first air-fuel mixture is supplied to the time interval in which the second air-fuel mixture is supplied is determined selectively on the basis of the NOx concentration of the exhaust gas of the internal-combustion engine, an NOx emission concentration specified in an emission standard, and the NOx reduction ratio of the NOx reducing catalytic converter.

4. A fuel injection control method according to claim 1, wherein the ratio K is determined according to the duration of operation of the internal-combustion engine under predetermined operating conditions.

5. A fuel injection control method that controls the air-fuel ratio of air-fuel mixture to be supplied to an internal-combustion engine provided in its exhaust system with an NOx reducing catalytic converter effective in a fuel-lean air-fuel ratio condition, said fuel injection control method comprising controlling the air-fuel ratio of the air-fuel mixture on the basis of parameters indicating the operating condition of the internal-combustion engine, wherein a first air-fuel mixture of a stoichiometric or a fuel-rich air-fuel ratio and a second air-fuel mixture of a fuel-lean air-fuel ratio are supplied alternately for predetermined time intervals respectively, and wherein a ratio K of the time interval in which the first air-fuel mixture is supplied to the time interval in which the second air-fuel mixture is supplied is determined selectively on the basis of the NOx concentration of the exhaust gas of the internal-combustion engine, an NOx emission concentration specified in an emission standard, and the NOx reduction ratio of the NOx reducing catalytic converter.

6. A fuel injection control method according to claim 5, wherein the ratio K is determined according to the parameters indicating the operating condition of the internal-combustion engine.

7. A fuel injection controller for controlling the combustion of an internal-combustion engine provided in its exhaust system with an NOx reducing catalytic converter effective in a fuel-lean air-fuel ratio condition, and the air-fuel ratio of air-fuel mixture to be supplied to the internal-combustion engine, characterized in controlling the air-fuel ratio of the air-fuel mixture to be supplied to the internal-combustion engine on the basis of parameters indicating the operating condition of the internal-combustion engine, wherein a first air-fuel mixture of a stoichiometric or a fuel-rich air-fuel ratio and a second air-fuel mixture of a fuel-lean air-fuel ratio are supplied alternately for predetermined time intervals respectively, and wherein a ratio K of the time interval in which the first air-fuel mixture is supplied to the time interval in which the second air-fuel mixture is supplied is determined selectively on the basis of the NOx concentration of the exhaust gas of the internal-combustion engine, an NOx emission concentration specified in an emission standard, and the NOx reduction ratio of the NOx reducing catalytic converter.

* * * * *